United States Patent [19]

Vernondier

[11] Patent Number: 4,994,944

[45] Date of Patent: Feb. 19, 1991

[54] DECORATIVE LIGHTING SYSTEM

[75] Inventor: David R. Vernondier, Woking, England

[73] Assignee: Consumerville Limited, Shepperton, England

[21] Appl. No.: 328,455

[22] Filed: Mar. 24, 1989

[30] Foreign Application Priority Data

Mar. 31, 1988 [GB] United Kingdom ..... 8807758

[51] Int. Cl.[5] ..... F21V 1/00

[52] U.S. Cl. ..... 362/238; 362/219; 362/223; 362/240; 362/249; 362/800; 439/210

[58] Field of Search ..... 362/240, 238, 800, 362, 362/249, 219, 223, 221, 222, 225, 145, 146, 152, 153; 439/419, 232, 210, 541, 346, 239

[56] References Cited

U.S. PATENT DOCUMENTS

| | | | |
|---|---|---|---|
| 3,755,663 | 9/1973 | George, Jr. | 362/249 |
| 4,042,290 | 9/1977 | Czitrom | 439/232 |
| 4,096,379 | 6/1978 | Taylor | 362/235 |
| 4,413,311 | 11/1983 | Orenstein | 362/362 |
| 4,607,317 | 8/1986 | Lin | 362/362 |
| 4,654,765 | 3/1987 | Laidman | 362/238 |
| 4,855,882 | 8/1989 | Boss | 362/238 |

FOREIGN PATENT DOCUMENTS

| | | | |
|---|---|---|---|
| 2308051 | 11/1976 | France . | |
| 48-639 | 12/1972 | Japan | 362/238 |

*Primary Examiner*—James C. Yeung

*Attorney, Agent, or Firm*—Dennison, Meserole, Pollack & Scheiner

[57] ABSTRACT

A lighting system includes a plurality of modular components, each comprising an elongate strip of finite length, supporting or constituting an elongate lighting circuit extending along the strip and connector means for connecting adjacent strips end to end, and electrically connecting the lighting circuits thereon to enable a voltage to be applied across a series of illuminating devices provided at predetermined spaced locations along the length of the strips so connected. Preferably, the illuminating devices on each strip are connected in series, and the series connected illuminating devices associated with each strip are connected in parallel with the series connected illuminating devices associated with each of the other strips.

14 Claims, 11 Drawing Sheets

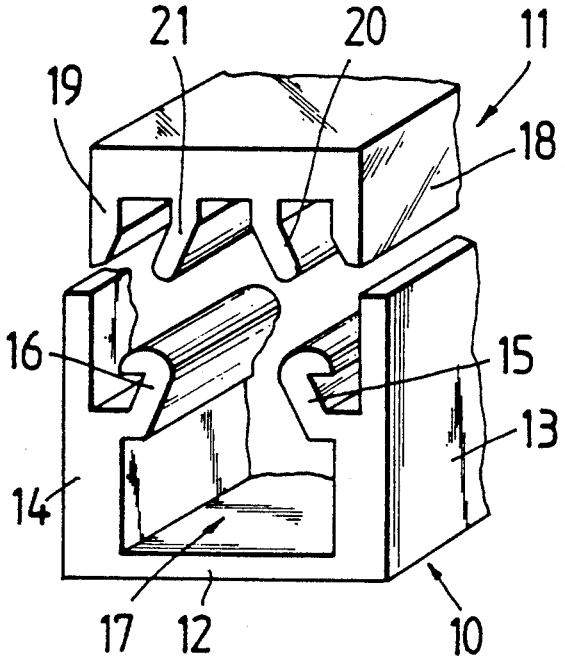
FIG. 1.
FIG. 2.
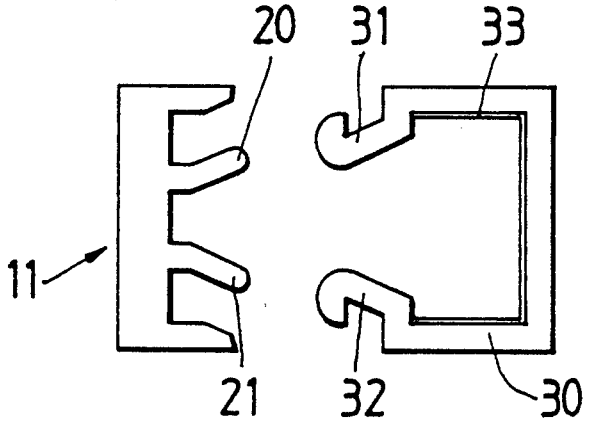
FIG. 3.
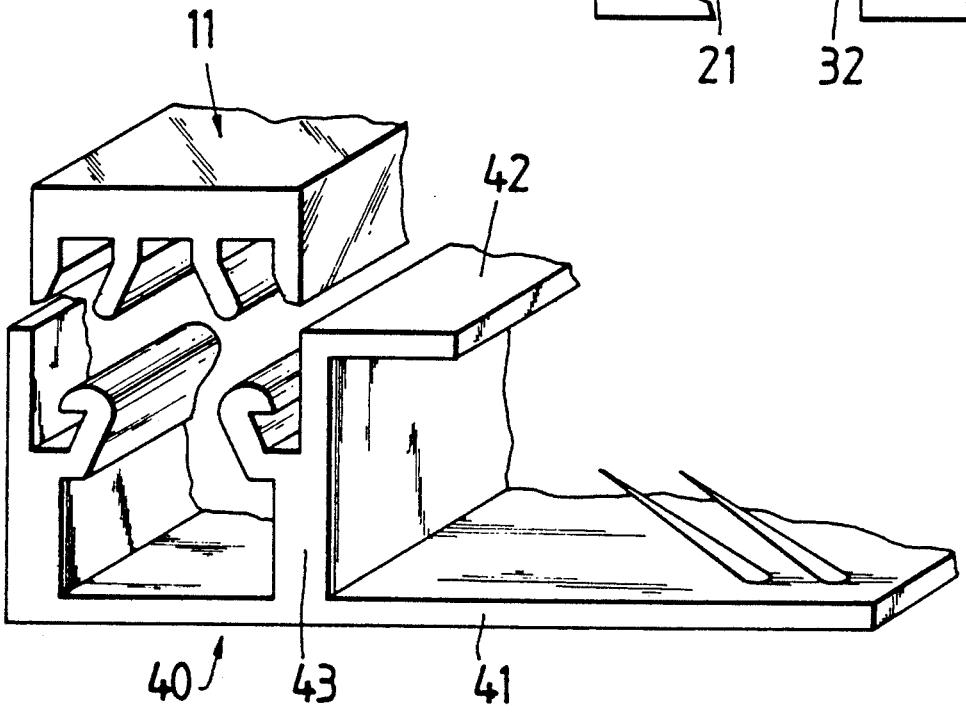

DECORATIVE LIGHTING SYSTEM

FIELD AND BACKGROUND OF THE INVENTION

This invention relates to a lighting system which enables elongate lengths of illumination to be provided for a wide range of decorative and other applications.

Linear lighting systems used hitherto have generally been in the form of extruded tubing of a resilient, translucent or transparent material, e.g. extruded plastics tubing. The tubing is illuminated by a series of bulbs connected together by electric wiring to form an elongate lighting string which is threaded through the tubing to provide an internal illumination means therefor. The tubular strip is then located where desired to provide an elongate lighting system for decorative or safety purposes. For example, a length of such illuminated tubing may be provided in a non-slip nosing across the front edges of the steps of a staircase. The lighting system may be used in flooring systems e.g. at a junction between different types of flooring or floor covering. It may be provided as a decorative embellishment e.g. on walls, or display systems, or along bar pelmets, wherever a decorative pencil-line of light is desired. When resilient tubing is used, the lighting system may follow non-linear paths, e.g. wound as a shallow spiral around columns or pillars.

However these previously known systems have certain technical and practical disadvantages. First of all, a length of the wiring incorporating the spaced apart illuminating elements does not provide a standard predictable length thereof owing to the flexibility of the wire connectors of the illuminating device which are soldered to the intermediate lengths of connecting wiring. Over a relatively long stretch there can be a very significant expansion or contraction of a supplied length of the illumination wiring resulting in a discrepancy with the length over which the illumination is required to extend. The illumination wiring which is usually stored on a roll, is relatively brittle owing to the soldered wire connectors associated with the illuminating devices, which are free to bend.

In practice, it is necessary to measure up on site the required extent of the linear illumination and then to order the required length which is cut by the supplier from a storage roll thereof. As stated above, the length when fitted on site may not match the requirement due to expansion or contraction of the supplied length. Moreover electrical connections have to be made on site, e.g. by soldering, to incorporate resistors in the system to control the voltage supplied to the illuminating devices, and to connect voltage supply lines, as well as to make any other necessary circuit connections.

SUMMARY OF THE INVENTION

The invention seeks to provide an improved linear lighting system in a modular form capable of enabling a variety of different lengths of elongate lighting strips to be assembled in a relatively quick, easy and convenient manner.

The invention provides a lighting system including a plurality of modular components, each comprising an elongate strip of a finite length, supporting or incorporating an elongate lighting circuit extending along the strip and connector means for engaging juxtaposed ends of said strips to connect the strips end to end and to electrically connect the lighting circuits thereof to form a continuous electrical lighting circuit which extends along the length of the strips, when connected end to end as aforesaid, and which is adapted to provide an electrical connection for applying a voltage across a plurality of illuminating devices to be mounted on the strips at predetermined spaced locations along the length of said continuous electrical lighting circuit.

Each of said strips may be in the form of a ribbon cable or an elongate rigid or semi-rigid circuit board having a linear, series or parallel circuit passing therealong with connection points formed in the circuit to receive illuminating devices.

The aforesaid continuous electrical lighting circuit may be adapted to connect said illuminating devices in parallel with one another.

In preferred embodiments of the invention, the aforesaid continuous electrical lighting circuit may be adapted to provide a series connection for all the illuminating devices to be mounted on each strip, and a parallel connection between the series connected illuminating devices associated with each strip.

The plurality of modular components may include a plurality of elongate strips as aforesaid of different finite lengths.

The elongate lighting circuit associated with at least one of said elongate strips may include means to connect a resistor in series with said illuminating device or devices to be mounted on the strip.

The aforesaid connector means may comprise at least one connector member for location between a pair of adjacent strips and having means for resiliently gripping each of said juxtaposed ends of the strips, and means for making an electrical connection between the adjacent ends of said elongate electrical lighting circuits associated with the strips.

A lighting system according to the invention may include a voltage supply connecting means for supplying a voltage to said continuous electrical lighting circuit at one or both ends thereof, said voltage supply connecting means comprising a terminal portion adapted to be resiliently gripped by a connector member as aforesaid which is to be resiliently engaged with one end of one of said strips, and having electrical connecting means for making an electrical connection between the electrical connection means of that connector member and a voltage supply.

A lighting system according to the invention may include flexible connecting means for electrically connecting a pair of strips which can be-.set at different angular positions with respect to one another, said flexible connecting means comprising connector portions each adapted to be resiliently gripped by a respective one of a pair of said connector members which are to be resiliently engaged with adjacent ends of said pair of strips, respectively; flexible means connecting .said connector portion; and electrical connecting means for making an electrical connection between the electrical connection means of said pair of connector members.

A lighting system according to the invention may further include a housing having a translucent or transparent wall or wall portion, for receiving said plurality of elongate strips when connected by said connector means.

Said housing may be in the form of an elongate tubular container.

Said tubular container may have a removably mounted wall section extending along its length.

Said tubular container may comprise an elongate base channel-section strip, and an elongate, translucent cover strip which can be removably engaged with the base strip to close the channel-section thereof.

Interengageable snap fastening means may be provided on said base strip and said cover strip.

Said base strip may be made of a resilient electrically insulating material. In other embodiments, the base strip may be metallic and relatively rigid, with an internal lining of an electrically insulating material provided to isolate said lighting circuit from the metallic base strip.

A plurality of base strips and cooperating cover strips which can be secured together may be provided to form required lengths thereof. Gasket means may be provided for effecting waterproof joints between adjacent base and cover strip combinations.

BRIEF DESCRIPTION OF THE DRAWINGS

Embodiments of the invention will now be described by way of example and with reference to- the accompanying drawings, in which drawings:

FIG. 1 is a perspective view of an end portion of an extruded base strip and cover strip combination for use with a lighting system according to the invention:

FIG. 2 is an end view of another base strip and cover strip combination for use with a system according to the invention;

FIG. 3 is a perspective view of an end portion of a further base strip and cover strip combination;

FIGS. 1OA and 1OB illustrate diagrammatically perspective details of two further cover strips:

DETAILED DESCRIPTION OF SPECIFIC EMBODIMENTS

Figure 4:
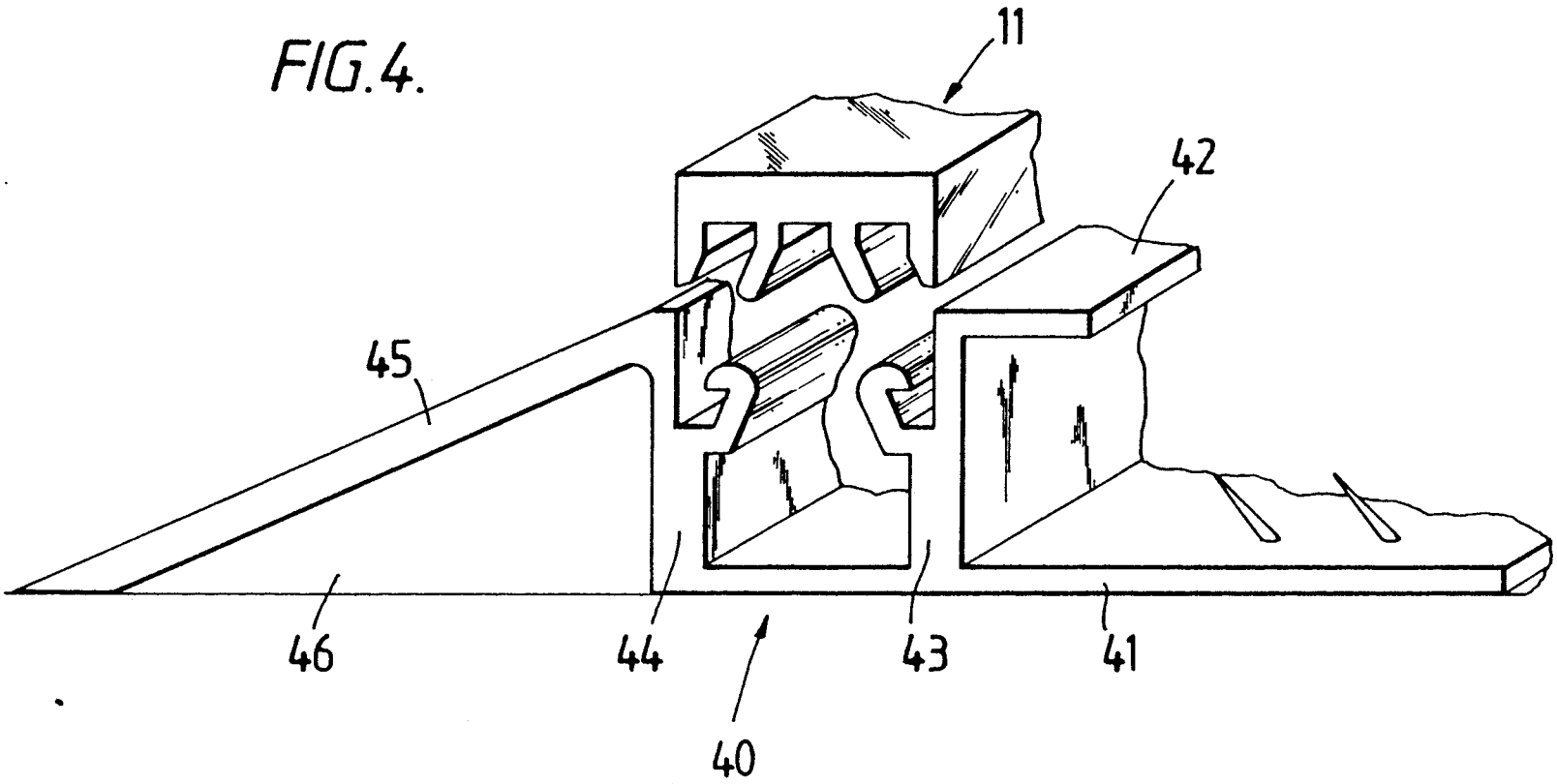
FIG. 4 is a perspective view of an end section of a further form of base strip and cover strip combination specifically for location between a carpeted area of a floor and an uncarpeted area thereof.

Referring to FIG. 1, there is shown a tubular housing for use with a linear lighting system according to the invention and comprising a base channel strip (10) and a cover strip (11). The base channel is made as an extruded plastics length having a flat base portion (12) with a pair of side walls (13 and 14). The side walls (13,14) are formed with inwardly extending resilient projections (15 and 16) which converge towards one another in the upward direction. The upper ends of the projections (15,16) are rounded in a semi-circular shape.

The cover strip (11) is an extruded translucent/transparent plastics element, for example a polycarbonate material, which is designed to form an insert into the upper end of the channel-section base strip (12) to provide a waterproof covering therefor which can be readily snapped into the base strip and, when required, can be readily levered out of the base section to provide access to the interior lighting compartment (17) defined within the lower portion of the base strip (10). The cover (11) has a pair of downwardly projecting side walls (18,19) which resiliently engage the upper portions of the side walls (13,14) of the base strip (10). The cover strip (12) also has a pair of elongate downward projections (20,21) which diverge from one another in the downward direction. The free edges of these projections (20,21) are rounded in a semi-circular shape.

The projections (15,16) of the base strip and the projections (20,21) of the cover strip are dimensioned to provide snap connection means between the cover strip (11) and the base strip (10) when the cover strip is pressed downwardly onto the base strip. As the free ends of the projections (20,21) of the cover strip engage the upper ends of the projections (15,16) of the base strip, all these projections are deformed to allow the projections (20,21) to pass between the projections (15,16) and to provide a resilient connecting means therebetween when the cover strip (11) is fully inserted into the mouth of the channel-section base strip (10).

FIG. 2 shows a construction generally similar to that illustrated in FIG. 1. However in this case the base member (30) is formed as an aluminium or similar extrusion having a pair of upwardly extending connecting projections (31,32) with a similar form to the projections (15,16) of the embodiment of FIG. 2. The cover strip (11) is an extruded polycarbonate member as utilized in the FIG. 2 embodiment which fits on top of the base strip (30) with its elongate projections (20,21) forming a snap connection with the relatively rigid projections (31,32) of the base strip. In this embodiment a lining (33) of electrically insulating material is provided within the channel-section of the base strip (30) to prevent short circuiting of a lighting unit disposed in use in the base strip (30) or any other means of insulating electrical circuits.

In the embodiment of FIG. 3, the base strip (40) is formed with a pair of lateral flanges (41,42) formed integrally with the right-hand side wall (43) of the channel-section base strip (40). The upper flange (42) projects laterally from the upper portion of the side wall (43) whereas the lower flange (41) extends laterally from the lower edge of that wall and is co-planar with the base of the channel-section of the strip (40). The lower flange (41) projects laterally to a much greater extent than the upper flange (42). This construction is adapted for location along the edge of a flooring area to receive an edge portion of a carpet or other floor covering between the flanges (41,42).

FIG. 4 illustrates a construction generally similar to that shown in FIG. 3 with the addition of a sloping flange (45) which is integral with the upper end of the left-hand side wall (44) of the base strip 40) to extend downwardly therefrom to engage an adjoining uncarpeted floor area (46). This construction could therefore be used for placing an illuminated strip between a carpeted floor area and an adjoining wooden, concrete or lino floor area.

Figure 5:
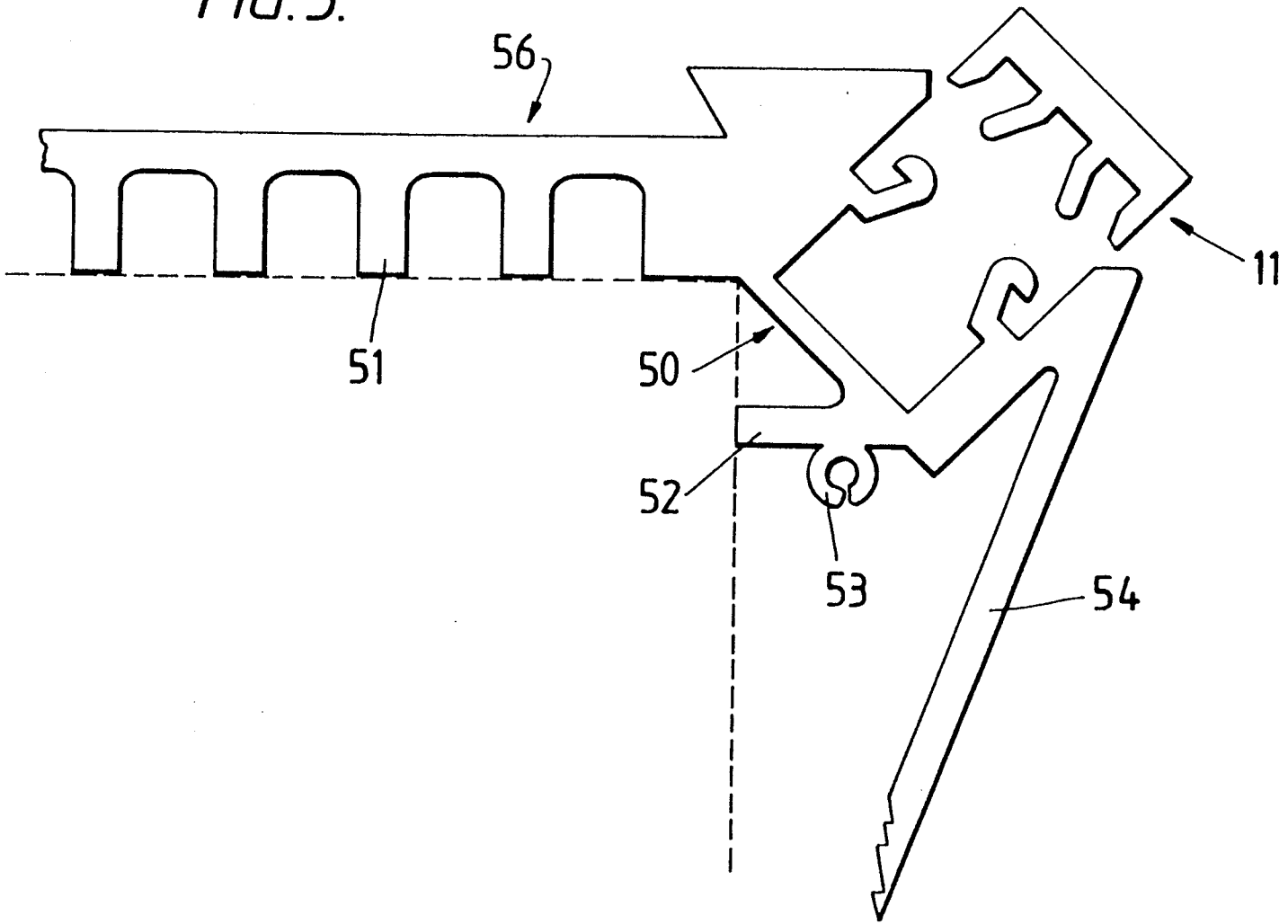
FIG. 5 is an end view of a base strip and cover strip assembly incorporated in a stair tread nosing unit.

FIG. 5 shows a further construction of a channel-section base strip and cooperating covering strip which is incorporated in a stair nosing device. The general form of the base strip (50) is similar to that shown in FIG. 1 and a similar insert member (11) is used therewith. The base strip (50) is formed integral with and oblique to a stair tread engaging portion (51) formed at its upper surface with a rebate (56) for receiving a non-slip insert. The base strip (50) is therefore set at the upper edge of the riser portion of the stair to provide an illuminated nosing therefor. The base channel-strip (50) is formed with an obliquely extending leg portion (52) for engaging against the stair riser and leg portion (52) is formed at its ends with eyelets (53) for receiving screws for fixing end caps for covering the opposite open ends of the base strip (50) and cover strip (11) combination. The base strip (50) is also formed with an integral side plate (54) which extends from the upper end of its right-hand side wall downwardly and inwardly towards the stair riser. The free edge of the plate (54) is formed with a gripping portion to engage carpeting or other floor covering lying over the stair riser.

In other constructions, the tubular housing may be in the form of a one-piece elongate member having an axial internal cavity to receive a lighting system according to the invention. The member may be, for example,. square, circular, oval or polygonal in shape. It may be made, for example, of glass, polycarbonate, acrylic or polyvinylchloride, so that it can be either rigid or flexible in construction. The tube may be ribbed along its external surface to provide a reinforced construction. Such a construction may have many possible applications, for example, for providing a neat, attractive and unobtrusive illumination for paintings or other works of art, or for alternatives to night-lights.

A lighting system according to the invention comprises elongate electric lighting circuitry which may be received within the lighting chamber or internal cavity of a tubular housing, e.g. of the types described above. The lighting circuitry may however be located in a wide range of different types of containers to suit a wide variety of possible usages; indeed the circuitry could be located, for example, between two sheets of glass or the circuitry could be surface mounted and used without any housing at all.

A lighting system according to the invention comprises a set of elongate circuit strips each of a finite, predetermined length, which are adapted for the connection thereto of lighting elements which may be in the form, for example, of incandescent indicators, light emitting diodes, or other suitable light emitting sources which are spaced along the system, when assembled, at predetermined spaced intervals, generally, but not necessarily, regularly spaced intervals. The elongate strips could be in the form of ribbon cable having the circuit wiring provided therein, the ribbon cable being pierced with a punching tool at given positions to receive fittings for locating the illuminating members and other ancilliary electrical circuit elements. However, it is preferred that the elongate strips are provided by circuit boards, which are preferably semi-rigid so that they have a certain amount of flexibility, of predetermined lengths on which the electric circuitry is provided.

Figure 6:
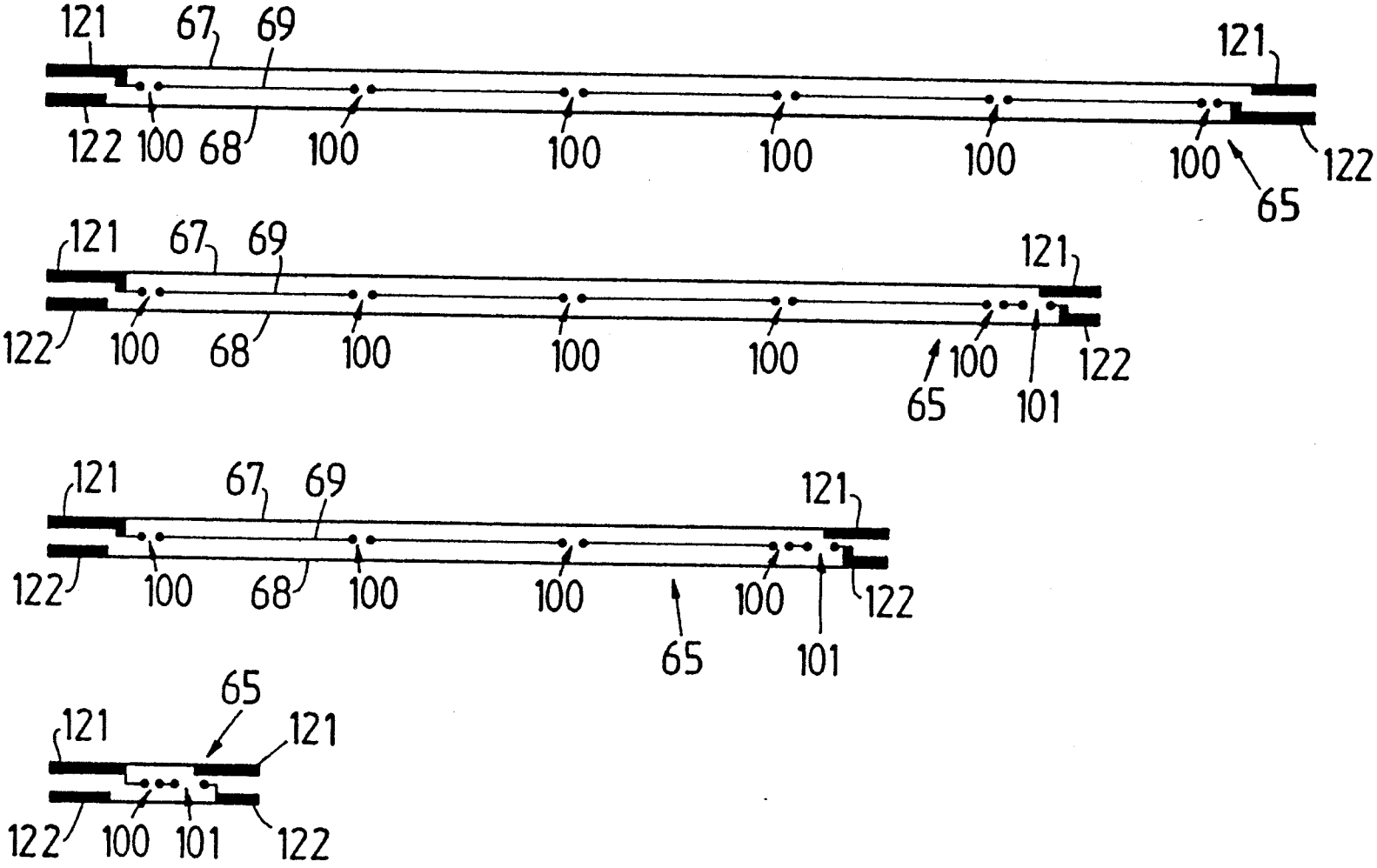
FIG. 6 is a plan view of a series of lighting circuit boards of a lighting assembly according to the invention.
Figure 7:
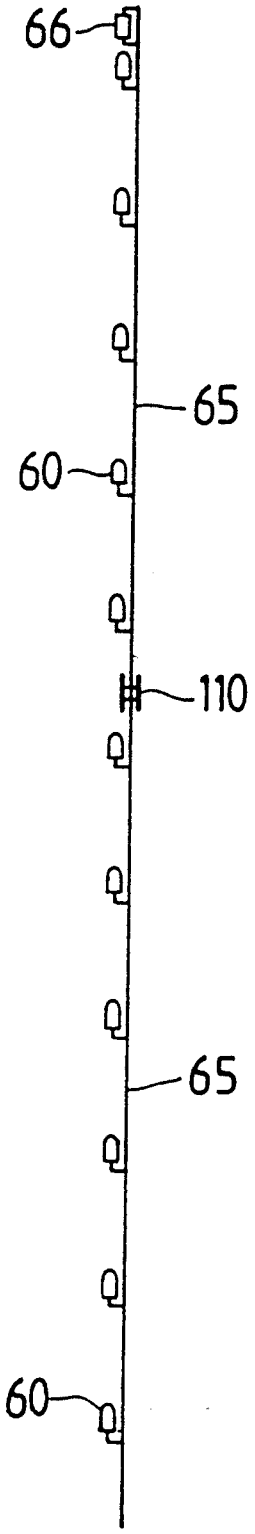
FIG. 7 is a side view of a pair of interconnected circuit boards of the type as shown in FIG. 6 having electrical components, including illuminating elements, located thereon.
Figure 14A:
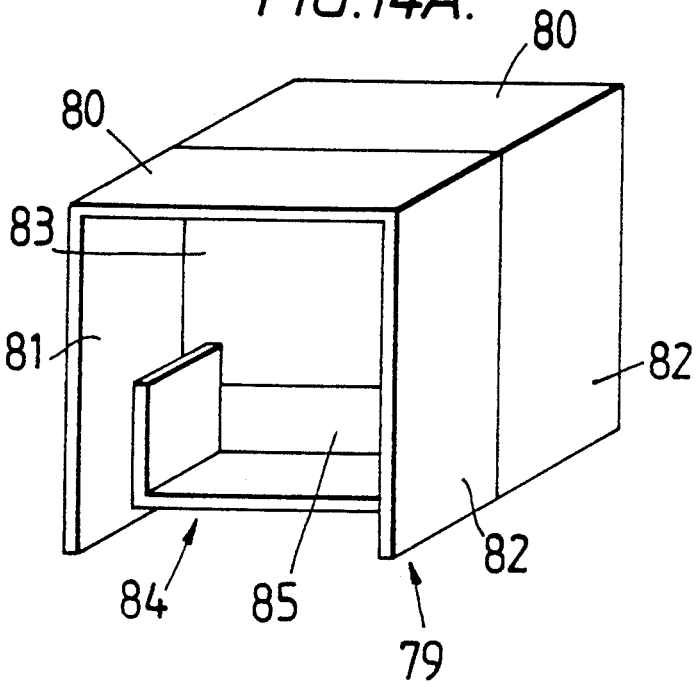
FIGS. 14A and 14B are respectively a perspective view and a front elevation of a joining gasket.
Figure 14B:
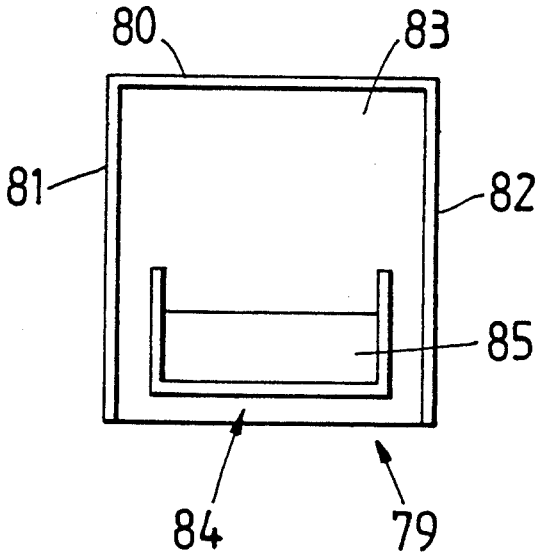

In preferred embodiments of the invention, lighting systems according to the invention comprise a set of a number of different length, flexible circuit boards on each of which the electric circuitry is arranged to provide a series connection between the lamp elements, as illustrated in FIG. 6. Each circuit board (65) has two voltage supply lines (67,68) and an electric line (69) connected in parallel across the voltage supply lines (67,68), which connects in series the lamps associates with that board and any compensating resistor. The system illustrated in FIG. 6 comprises four different, finite lengths of circuit board, having circuitry for mounting six, five, four and one lamp, respectively, at regularly spaced positions (100). When less than six lamps are used on a circuit board, an appropriate resistor is generally mounted at a position (101) in order to make all the circuit boards in the set voltage compatible with one another. Generally lamps (60) of the same voltage rating are used throughout, although this is not essential. Whatever lamps (60) are used, appropriate resistors (66) (see FIG. 7) are used to make all the circuit boards in the set voltage compatible with each other and with the desired supply voltage.

Furthermore different sets of standard circuit boards can be provided having different spacings between the location positions of the lamps for any linear length of illumination constructed by coupling the appropriate number and size of circuit boards end to end using coupling elements described below. Examples of such spacings are 50 mm, 75 mm and 100 mm. However in other constructions irregular spacings may be selected for special effects.

In order to assemble -required linear lengths of the light system from an appropriate number and size of circuit boards in the set, coupling elements (110) as illustrated in FIGS. 15A–15E are used. Each coupling element (110) comprises an outer housing (111) comprising an upper part (112) and a lower part (113) snap fitted together. Each housing part (112,113) comprises an oblong tray-like member having upstanding peripheral wall portions with resilient pegs (114) provided on abutting edges of the wall portions of the two housing parts (112,113) to engage in corresponding apertures in the opposite abutting edges to provide a snap connection means for the two housing parts, which are disposed in inverted positions with respect to one another.

Figure 15A:
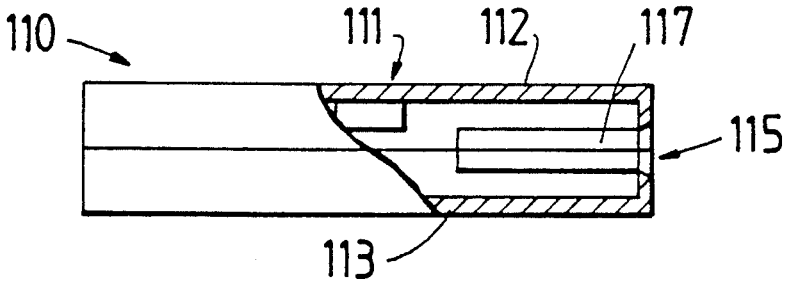
FIGS. 15A–15E illustrate a coupling element for circuit boards of FIGS. 6 and 8 and comprise respectively a side view partly in crosssection of the coupling element, a plan view partly in crosssection of the coupling element; a cross-sectional view of an upper portion of the coupling element; an end view of the upper portion of the housing of the coupling element; and a side view of one electrical connector element of the coupling element.
Figure 15B:
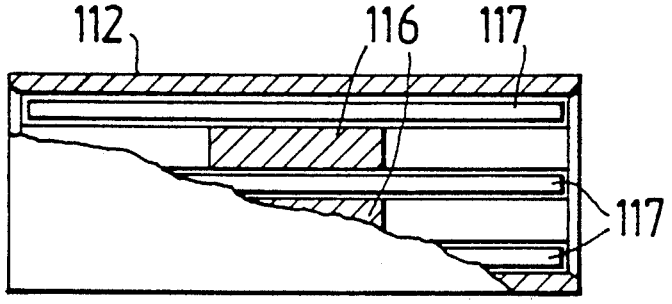
Figure 15C:
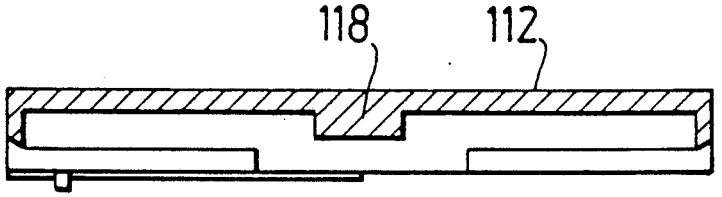
Figure 15D:
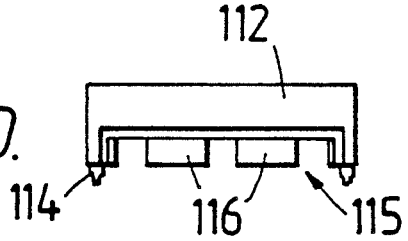
Figure 15E:
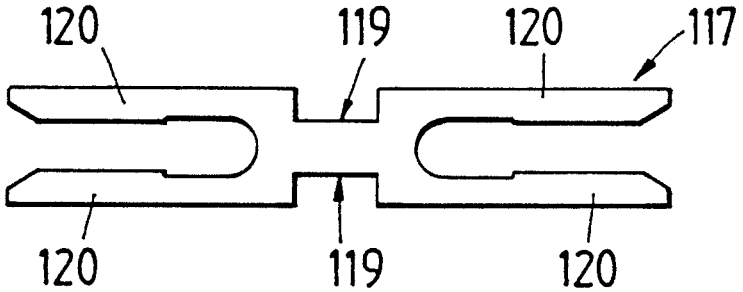

The end walls of the housing part (112,113) are recessed to provide an entry slot (115) for receiving end portions of two circuit boards to be joined end to end by the coupling element (110). Within each housing part (112,113), there are two longitudinally extending dividing walls (116) for laterally spacing apart three plate-like electrical connecting elements (117), as illustrated in FIG. 15E within the housing (111). Three location formations (118) of oblong crosssection are integrally formed between the dividing walls (116) and the longitudinal side walls of the parts (112,113) for engagement in centrally located recesses (119) in the connecting elements (117). Each connecting element (117) has, at each end, a pair of resilient forks (120) for making electrical connections with the circuitry provided on the circuit boards (65).

Therefore selected pairs of circuit boards (65) can be joined by using a respective coupling element (110). An end portion of each board is engaged in the slot (115) at a respective end of the housing (111). The pairs of forks (120) make gripping engagement with the end portion of the circuit board and electrical contact with the respective voltage supply line terminals (121,122) at the end of the circuit board. The voltage supply lines of the pairs of circuit boards (65) so connected by respective coupling elements (110) are thereby electrically connected to each other. A simple coupling and electrical connection is thereby achieved by merely pushing end portions of the circuit boards (65) into opposite ends of the coupling element (110). It will be noted that only two electrical connecting elements (117) are employed in operation with the central element (117) being redundant. However with other possible circuit arrangements on the circuit boards, three connecting elements (117) are sometimes required.

It will be appreciated that the series connected lamps of each electric circuit of a series of circuit boards (65), when connected as described above by coupling elements (110), are connected in parallel with the series connected lamps associated with each of the other circuit boards in the set. This is termed a "series-parallel" circuit arrangement.

Figure 16A:
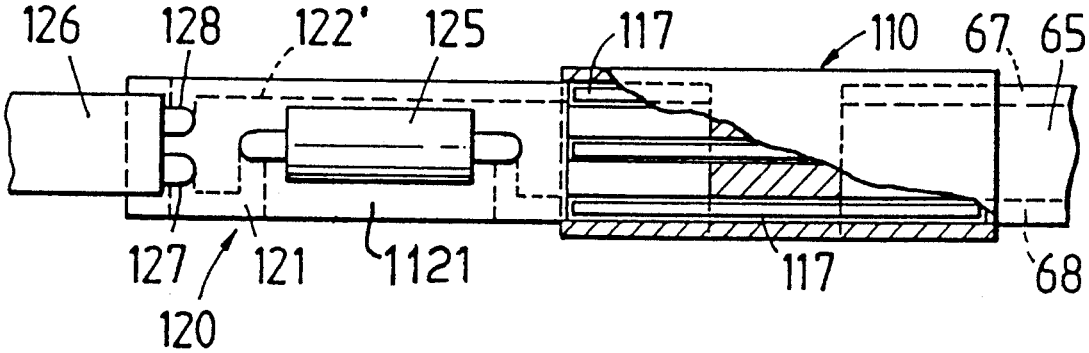
FIGS. 16A–16D are, respectively, a plan view partly in section; a side view partly in section; a circuit diagram; and a diagrammatic perspective view of a voltage supply connector device.
Figure 16B:
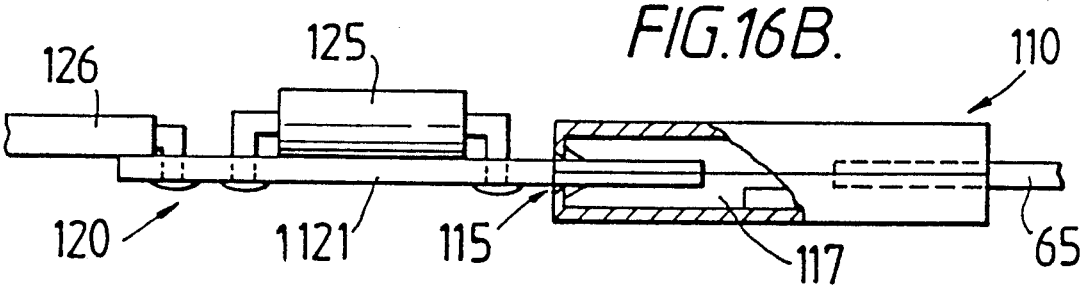
Figure 16C:
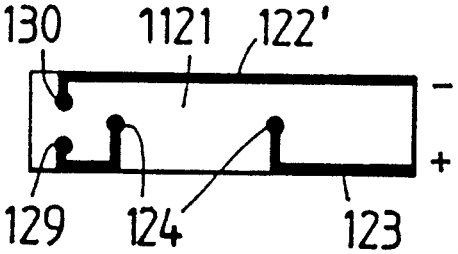
Figure 16D:
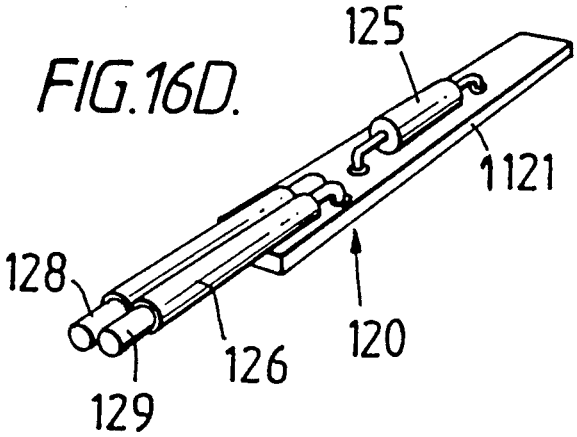

Referring to FIGS. 16A–16D, a voltage supply connector element (120) is provided for coupling to one end of a linear series of circuit boards (65) joined together by coupling elements (110). The connector element (120) includes a terminal portion (121) provided by a short strip of circuit board (1121) having a circuit track arrangement, as illustrated in FIG. 16C, provided thereon. The circuit track comprises a negative electric line (122) and a positive electric line (123) which has connector points (124) for connection therein, e.g. by soldering, of a fuse (125). A supply cable (126) has positive and negative feed wires (127,128) which are connected by soldering to positive and negative terminal connector points (129,130) on the circuit board (1121). The free end portion of the circuit board (1121) is inserted into a slot (115) of a coupling element (110) located at the end of a circuit board (65) disposed at one end of the linear series thereof. The outer pair of electrical connecting elements (117) of the coupling element make electrical contact with the positive and negative lines (123,122), on the circuit board (1121) to connect the supply voltage across the voltage supply lines (67,68) on the circuit board (65), to provide the voltage supply of the lighting system.

Figure 17A:
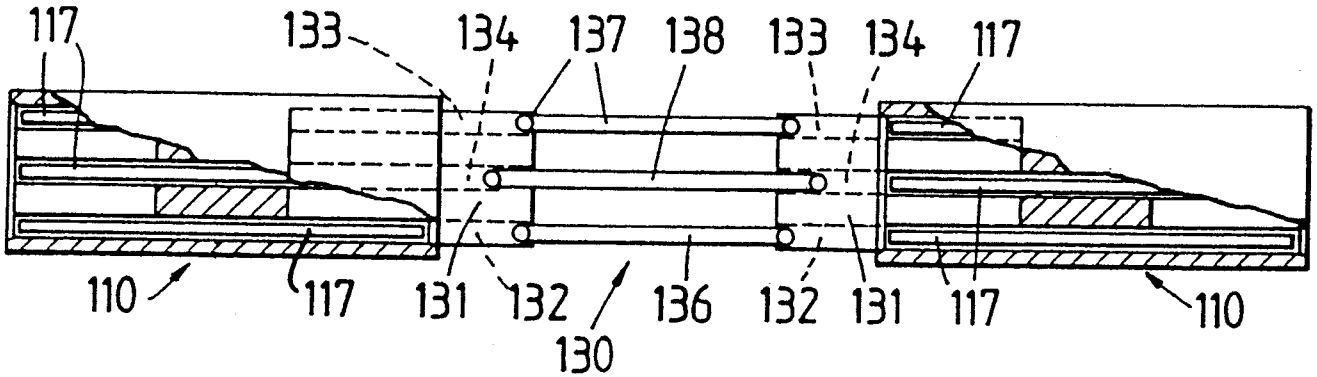
FIGS. 17A–17C are, respectively, a plan view, partly in section; a side view partly in section; and a circuit diagram of a connector portion, of a flexible connector device for connecting circuit boards of FIGS. 6 and 8.
Figure 17B:
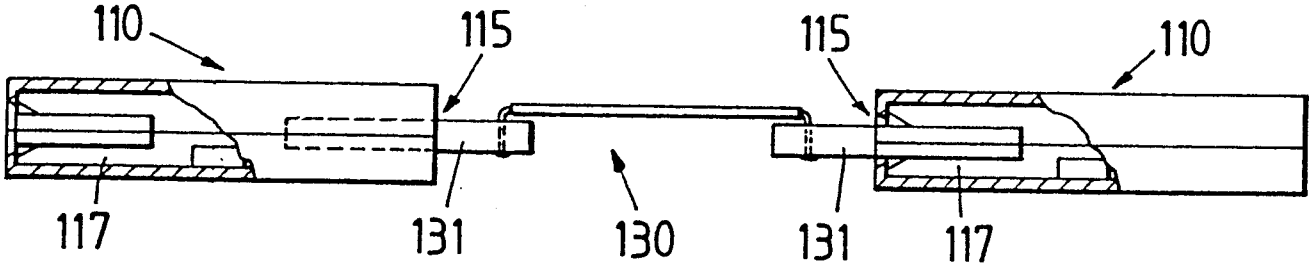
Figure 17C:
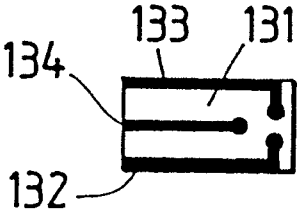

Referring to FIGS. 17A–17C, there is shown a flexible connecting device (130) for allowing the connection of adjacent circuit boards in a series thereof, which boards may be set at different angular positions relative to one another. The device (130) comprises a pair of similar connector portions (131) made of a short strip of circuit board having a circuit provided thereon, as illustrated in FIG. 17C, consisting of three electric lines, i.e. positive line (132), a negative line (133) and a central line (134). The connector portions (131) are joined by flexible jumper wires (136,137,138) which electrically connect the positive lines (132), the negative lines (133) and the central lines (134) on the connector portions (131).

If a lighting system according to FIG. 6 is required to fit around three sides of a rectangular structure, the overall length is measured and the required set of components selected, as described above, for coupling together to form the lighting system. Circuit board (65) can be cut to fit around each corner with the cut pieces then being coupled together using flexible connector devices (130). Firstly, coupling elements or devices (110) are engaged with the cut ends of the circuit board (65). Then, the connecting portions (131) of a connector device (130) are engaged in the open slots (115) of the respective coupling devices (110). The flexible jumper wires allow the cut sections of the circuit boards (65) to be located along different sides of the aforesaid structure.

In such arrangement, the voltage supply lines (67,68) of the two parts of the severed circuit board (65) are connected by the jumper wires (136,137) and the series connection lines (69) are connected by the jumper wire (138).

For a person who is particularly skilled with the system, it would be possible to select a set of circuit boards (65) which fit precisely the lengths along each side of the rectangular structure without any need for cutting any of the circuit boards (65). The same coupling devices (110) and flexible connector devices (130) are utilized at the corners, but in this arrangement the central jumper wire (138) is redundant in operation.

When the modular components of a lighting system according to the invention are connected to extend over relatively long lengths, voltage supply connectors may be connected to both ends of the electrically coupled series of circuit boards (65) to maintain the voltage along the entire length of the system.

As stated above, different standard sets of circuit boards as illustrated in FIG. 6 may be made available each set having a different spacing between the lamps. In order to facilitate use of a "series-parallel" lighting system according to the invention, a set of calculation charts are preferably provided for each set of circuit boards for operation at a predetermined supply voltage and using illuminating devices of a predetermined operating voltage. The charts give a concordance between the number of lamps required, at the preselected spacing therebetween, for any length as measured on site. A further concordance chart then gives the required number of circuit boards of the different lengths in the set for that length in dependence on the number of lamps required. It is therefore a simple matter, on site of measuring the required length of linear illumination required, and from that determining from the concordance charts the required different length circuit boardsand the number thereof, which are then removed from the set and coupled together very simply using the required number of coupling elements (110). The linear lighting system is then completed by connecting at one end of the linear series of joined circuit boards (65) a voltage supply connector element.

Figure 8:
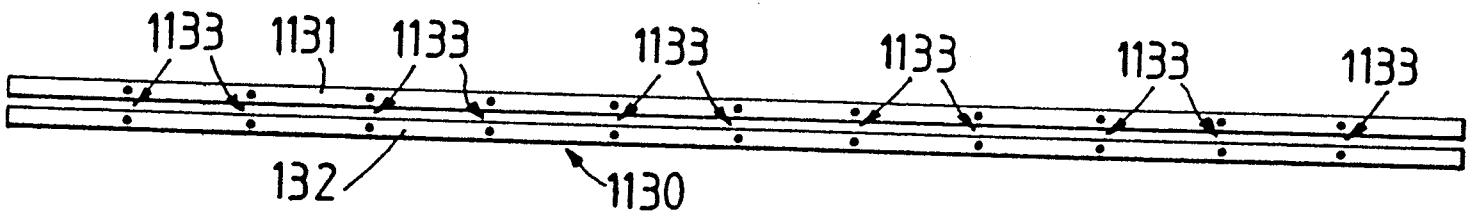
FIG. 8 is a diagrammatic representation of a circuit board providing a parallel-arranged lighting circuit.
Figure 9A:
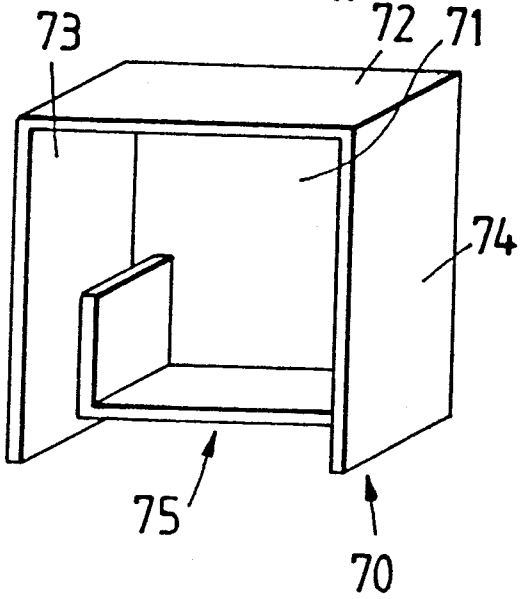
FIGS. 9A–9D are respectively a perspective view, a vertical section, a front elevation, and a plan view of an end cap for use in a lighting system according to the invention.
Figure 9B:
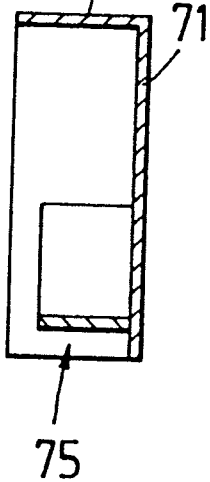
Figure 9C:
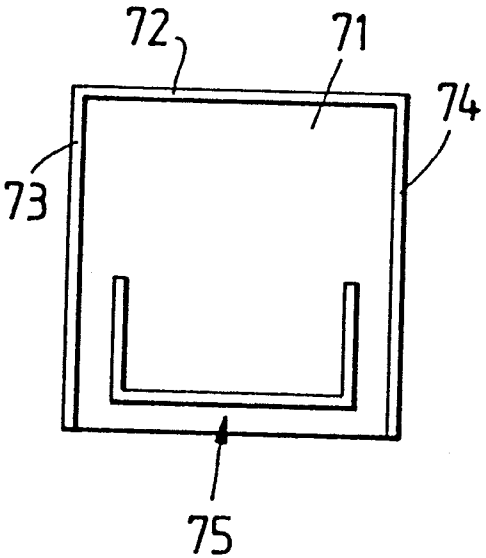
Figure 9D:
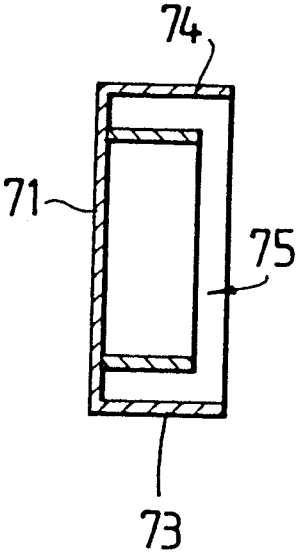
Figure 10A:
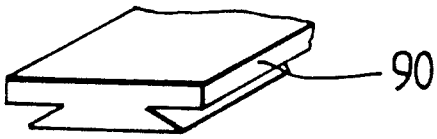
Figure 10B:
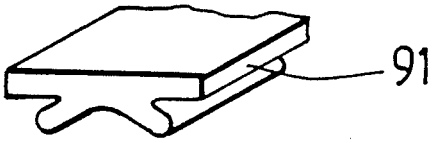
Figure 11A:
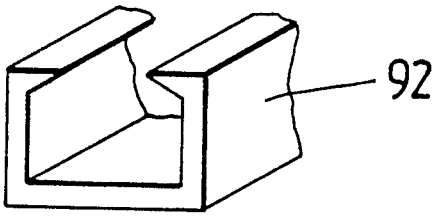
FIGS. 11A and 11B illustrate diagrammatically perspective details of two further forms of base strips.
Figure 11B:
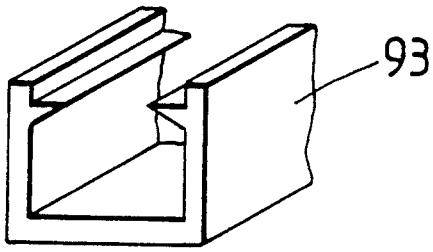
Figure 12:
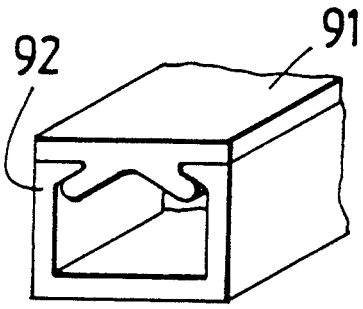
FIG. 12 illustrates a combination comprising the base strip of FIG. 11A fitted with a cover strip of FIG. 10B.
Figure 13:
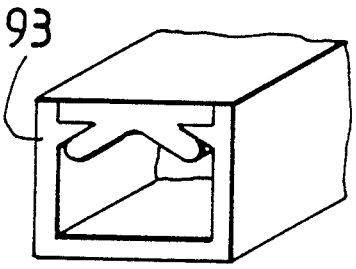
FIG. 13 illustrates a combination of a base strip of FIG. 11B fitted with a cover strip of FIG. 10B.

FIG. 8 illustrates an alternative electrical circuitry for the circuit board elements (1130) of a lighting system according to the invention. In this case each lamp is connected in parallel across the voltage supply lines (1131,1132) at regularly spaced positions (1133), providing an entirely "parallel" circuit arrangement of the lamps. In this system a single standard length of circuit board would normally be provided together with connector elements (110), because an end circuit board can be cut between any two adjacent lamp positions to fit the required length of the system. This is not, of course, possible with a "series-parallel" arrangement.

The "series-parallel" arrangement will generally be the preferred construction for a lighting system according to the invention because the lamps required are of lower rated voltages so that a greatly reduced current flow, e.g. one quarter the current of a parallel arrangement, is present in operation of the system. This provides a safer system which is generally more compact because lower rated, and therefore smaller components are needed. Moreover the voltage drop along the length of a "series-parallel" arrangement is less than with an entirely "parallel" arrangement so that longer. linear lengths can be achieved with a "series-parallel" system. A specific example of a practical system according to the invention is designed to operate at 24V (AC or DC) with lamps of 5V for a "series-parallel" arrangement, and a maximum current flow of 3 amps.

It is possible to include other electronic circuitry on the circuit boards, e.g. to produce other special effects. For example, a flashing system can be produced using an entirely "parallel" arrangement having zena diodes associated with each lamp and a switching circuit associated with the voltage supply to switch the polarity of the voltage supply lines. This arrangement could employ three voltage supply lines, two separate positive lines and one neutral line with alternate pairs of lamps plus controlling zena diodes being connected between the neutral line and a respective positive voltage supply line which together with a corresponding switching circuit produces a linear flowing effect by lighting in sequence the lamps in each group of four thereof along the length of the lighting system. In this case all three of the electric connectors (117) of the intermediate coupling elements (110) is employed to make electrical connections between the neutral and the two positive supply lines on adjacent circuit boards.

A lighting system according to the invention would normally be supplied as a kit comprising standard finite length of flexible circuit boards and coupling elements allowing any required linear length to be built up from these components. The positioning of the lamps on the circuit boards, and the length of the coupling elements is such that, when a set of such boards are coupled in a linear series, the required predetermined spacing of the lamps along the entire linear length of the coupled boards is achieved. Furthermore, further boards may be provided for an end of any coupled series to accommodate a voltage supply connecting element whilst still maintaining the required predetermined spacing relationship between the lamps along the entire length of any coupled series of circuit boards.

Production of the above described circuit boards (65) may be carried out as follows. Each strip (65) may be, for example 50 cm long, 5 mm wide and 1 mm thick. Ten or twenty strips and copper tracking thereof can be formed side by side on a single substrate. A router may separate the individual strips leaving connecting pips therebetween. Alternatively no routing may be carried; instead the strips may be separated at a later stage by a multi-saw device. The lamps and resistors are then inserted on the upper sides of the strips with the terminal portions pushed through the strips to engage solder pads on the copper tracking formed on the underside of the strips. The terminals are cropped and soldered to those pads. The boards are then introduced into a defluxing bath where they ar degreased and defluxed. They are blasted with lacquer or other insulating sealant in order to protect the copper tracking from oxidization. After the lacquer has dried the individual circuit boards are snapped apart and finished to remove the connecting pips or are separated by a multi-saw device.

Figure 18:
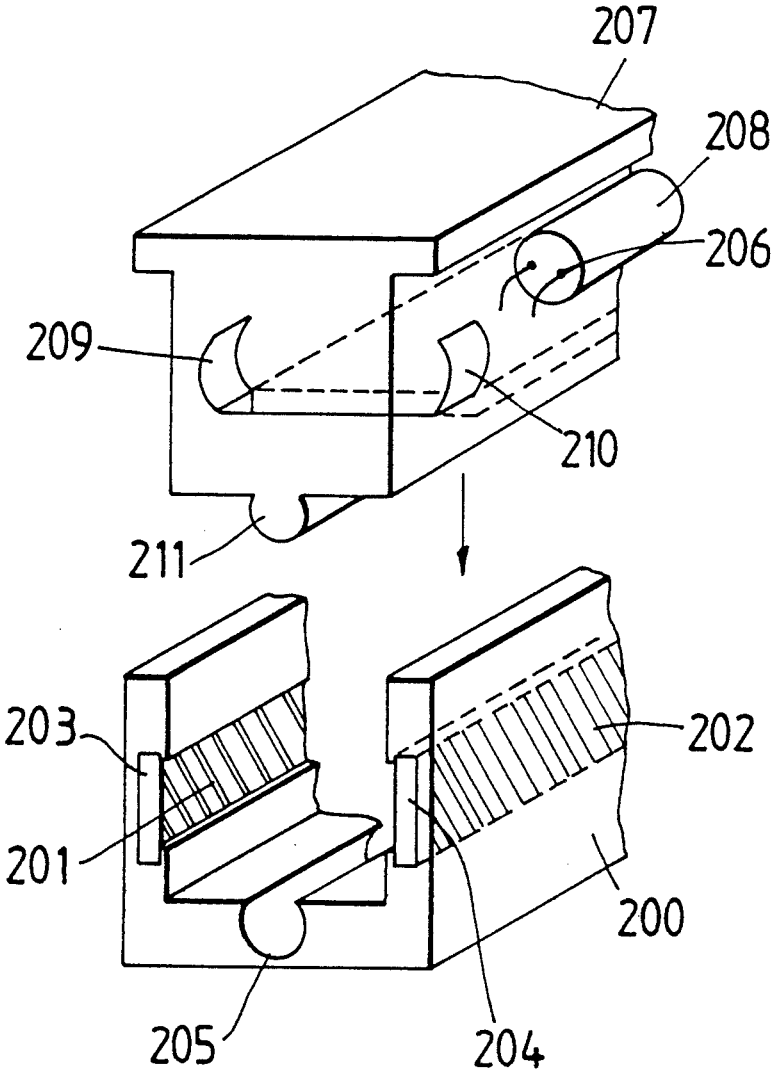
FIG. 18 is an exploded perspective detail of a further embodiment.

FIG. 18 illustrates another possible embodiment comprising a channel-section, extruded base housing (200) having electric voltage supply tracks (201 and 202) located within corresponding rebates (203 and 204) formed in the opposite side walls of the housing (200). The base of the housing is formed with a part-circular recess (205) extending along its length. The base housing extrusion is cut to a length in accordance with the required application and secured to the support surface by screws or adhesive.

The modules described above are, in this embodiment, in the form of circuit boards (206) which is encapsulated in an elongate cast or moulded section (207). The lamps (208) and their associated electric circuitry are provided on the circuit board (206) before encapsulation. Resilient contact members (209,210) associated with the circuitry on the board (206) protrude outwardly of opposite sides off the module (207) to make contact with the voltage supply tracks (201,202), when the module is located in the housing (200), to apply a voltage across the lamps (208). A part-circular beading (211) is provided along the underside of each module (207) to plug into the recess (205) in the base of the housing (200). In this way, the required lighting system is built up from a selected group of modules (207), equivalent to the above described set of circuit boards of the previous embodiments, to provide lamps at the required spaced locations along the housing (200), after it has been cut to length and secured to the respective support surface. The modules are then plugged into the housing (200) with the required electrical connections being made automatically by engagement of the contact member (209,210) with the voltage supply tracks (201,202) in the housing. A voltage supply is then connected to the end of the housing (200) to apply the required running voltage of the system across the tracks (201,202).

In embodiments as described above where three voltage supply lines are used, then a pair of such lines may be provided in one side wall of the housing (200). A further resilient contact is then provided in association with each module (207) and the two such contacts at the same side of the module, are disposed at positions staggered along the module.

I claim:

1. A lighting system including a plurality of modular components comprising a plurality of elongate strips of different finite lengths, each strip having an elongate lighting circuit extending along the strip, which lighting circuit provides a pair of voltage supply lines extending along the length of the strip and ann electrical connecting line for connecting at least one illuminating device in parallel between said pair of voltage supply lines, said lighting circuit of at least one of said strips being adapted to connect at least one predetermined resistor in series with said at least one illuminating device thereof so that the total electrical resistance of said at least one illuminating device and said at least one resistor of each of the strips is substantially the same to provide a set of voltage compatible elongate strips; connector means for engaging juxtaposed ends of said strips to connect the strips end to end, said connector means comprising at least one connector element for location between a pair of adjacent strips and having means for resiliently gripping each of said juxtaposed ends of the strips and means for making an electrical connection between the voltage supply lines at the adjacent ends of said electrical lighting circuits associated with the strips; and a voltage supply connector means for connecting to one end of one of said strips to provide an electrical connection between the voltage supply lines associated with that particular strip and a voltage supply.

2. A lighting system according to claim 1, wherein each of said modular components comprises a rigid or semi-rigid strip having said elongate lighting circuit provided thereon.

3. A lighting system according to claim 2, wherein said strip is in the form of a printed circuit board.

4. A lighting system according to claim 1, wherein said continuous electrical lighting circuit includes a series connection for all the illuminating devices to be mounted on each strip.

5. A lighting system according to claim 1, including flexible connecting means for electrically connecting a pair of strips which can be set at different angular positions with respect to one another, said flexible connecting means comprising connector portions each adapted to be resiliently gripped by a respective one of a pair of said connector members which are to be resiliently engaged with adjacent ends of said pair of strips, respectively; flexible means connecting said connector portions; and electrical connecting means for making an electrical connection between the electrical connection means of said pair of connector members.

6. A lightning system according to claim 5, wherein said flexible connecting means and said connector members, each have three separate electrical connection paths extending therethrough for electrically connecting said pair of voltage supply lines and the electrical series connection of said at least one illuminating device of an elongate strip which has been cut intermediate its length.

7. A lighting system according to claim 1 further including a housing having a translucent or transparent wall or wall portion, for receiving said plurality of elongate strips when connected by said connector means.

8. A lighting system according to claim 7 wherein said housing is in the form of an elongate tubular container.

9. A lighting system according to claim 8 wherein said tubular container has a removably mounted wall section extending along its length.

10. A lighting system according to claim 1, wherein said voltage supply connecting means comprises a terminal portion adapted to be resiliently gripped by a connector member as aforesaid which is to be resiliently engaged with one end of one of said strips and having electrical connecting means for making an electrical connection between the electrical connecting means of that connector member and a voltage supply.

11. A lighting system according to claim 1, further including a housing having a translucent or transparent wall or wall portion, for receiving said plurality of elongate strips when connected by said connector means.

12. A lighting system according to claim 11 wherein said housing is in the form of an elongate tubular container.

13. A lighting system according to claim 12 wherein said tubular container has a removably mounted wall section extending along its length.

14. A lighting system including a plurality of modular components comprising a plurality of elongate strips of different finite lengths, each strip having an elongate lightning circuit extending along the strip, which lighting circuit provides a pair of voltage supply lines extending along the length of the strip and an electrical connecting line for connecting at least one illuminating device in parallel between said pair of voltage supply lines, and the lighting circuit off at least one of said strips being adapted to connect at least one predetermined resistor in series with said at least one illuminating device thereof so that the total electrical resistance of said at least one illuminating device and said at least one resistor of each of the strips is substantially the same to provide a set of voltage compatible elongate strips; connector means for engaging juxtaposed ends of said strips to connect the strips end to end, said connector means comprising at least two connector elements having at opposite ends thereof means for resiliently gripping respective end sections of said strips and means for providing three separate electrical connection paths therethrough for connection to the voltage supply lines and the series connection of said at least one illuminating device of said electrical lightning circuit associated with each one of said strips; flexible connecting means having connector portions each adapted to be resiliently gripped by a respective one of said connector elements, flexible means connecting said connector portion, and electrical connecting means for making separate electrical connections between said three electrical connection paths of each of said connector elements when engaged with said connector portions, respectively; and a voltage supply connector means for connecting to one end of one of said strips to provide an electrical connection between said pair of voltage supply lines associated with that strip and a voltage supply.

* * * * *